United States Patent [19]

Bivins, Jr.

[11] 3,934,987

[45] Jan. 27, 1976

[54] BLENDING APPARATUS

[76] Inventor: Henry W. Bivins, Jr., 5030 Brummel, Skokie, Ill. 60076

[22] Filed: Mar. 25, 1974

[21] Appl. No.: 454,067

[52] U.S. Cl. ..... 48/180 C; 48/180 H; 48/196; 62/52; 261/117; 261/129; 261/156; /52;121

[51] Int. Cl.[2] ..... B01F 3/02

[58] Field of Search ..... 196/127; 261/117, 156, 261/152, 129; 55/23, 85, 220; 159/4 CC, 4 UM, 16 R; 48/144, 196 R, 180 R, 180 C, 180 B, 180 H, 180 P, 107, 190; 62/52, 121

[56] References Cited

UNITED STATES PATENTS

| | | | |
|---|---|---|---|
| 1,889,162 | 11/1932 | Thomas et al. | 62/52 |
| 2,343,727 | 3/1944 | Zenner | 62/52 |
| 2,920,946 | 1/1960 | Weaver et al. | 48/144 |
| 3,723,065 | 3/1973 | Dorrell et al. | 261/117 X |

*Primary Examiner*—Robert L. Lindsay,Jr.
*Assistant Examiner*—Peter F. Kratz
*Attorney, Agent, or Firm*—Wegner, Stellman, McCord, Wiles & Wood

[57] ABSTRACT

An apparatus for providing from a liquid fuel fluid supply an aerated gaseous fuel fluid. The liquid fuel fluid is delivered into a supply of hot air and the resultant mixture is delivered through a heat exchanger to an outlet. In the heat exchanger, a liquid fuel fluid phase of the mixture is converted to a gaseous phase thereof and condensed water is eliminated. The gaseous phase is superheated in a portion of the heat exchanger. A control is provided for limiting the level of the liquid phase in the heat exchanger.

16 Claims, 1 Drawing Figure

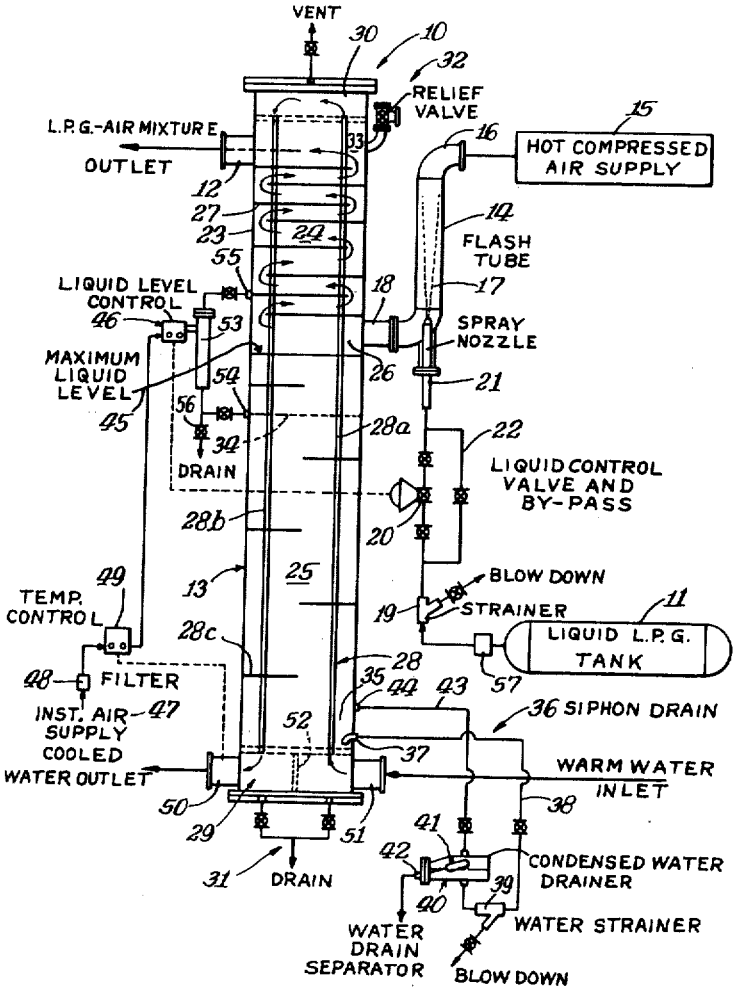

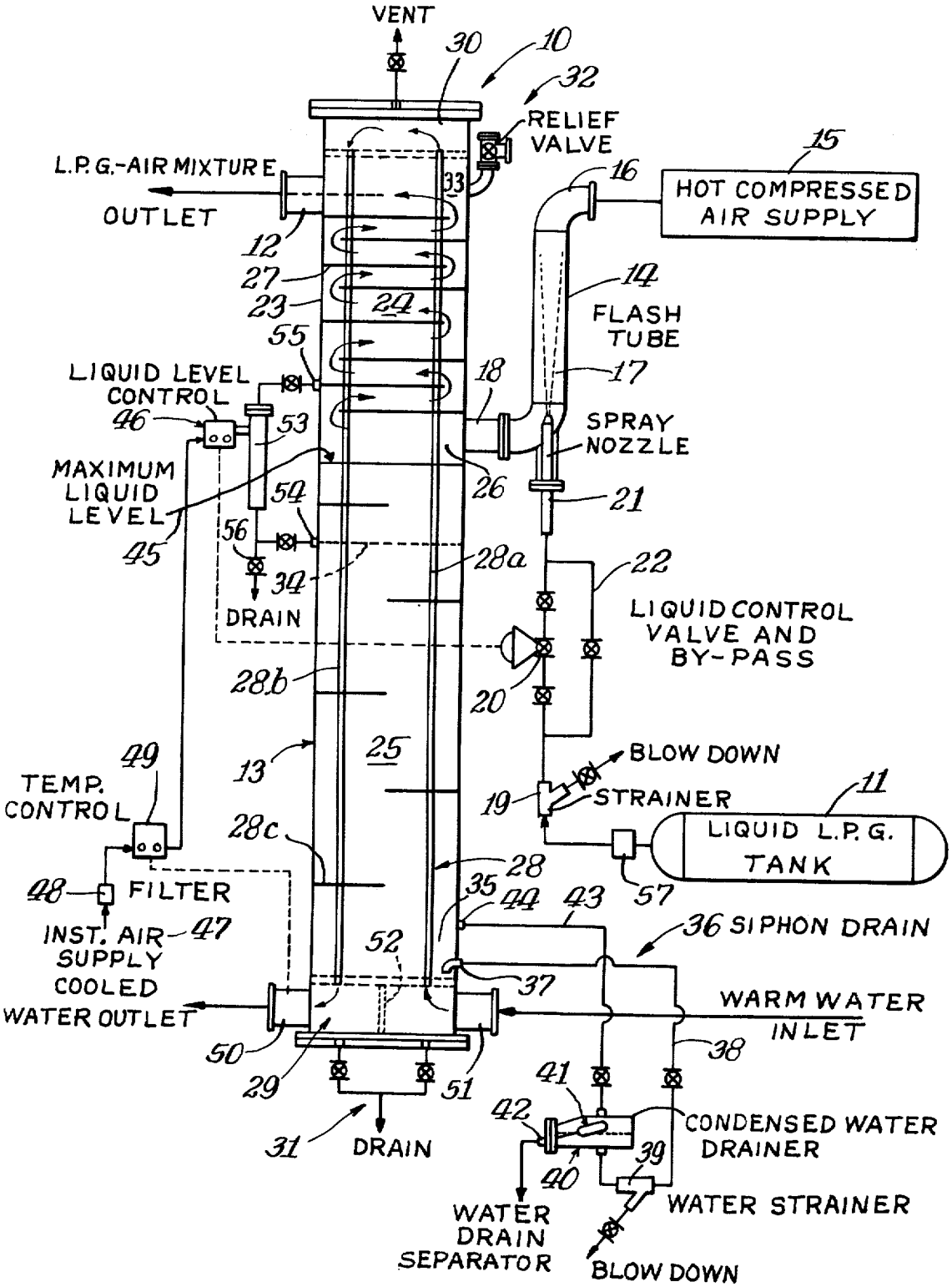
VENT
30
10
32
RELIEF VALVE
15
HOT COMPRESSED AIR SUPPLY
16
L.P.G.-AIR MIXTURE OUTLET
33
12
27
23
24
14
FLASH TUBE
55
LIQUID LEVEL CONTROL
46
53
18
17
SPRAY NOZZLE
MAXIMUM LIQUID LEVEL
45
54
26
21
56
34
DRAIN
28a
22
LIQUID CONTROL VALVE AND BY-PASS
28b
20
49
TEMP. CONTROL
13
25
BLOW DOWN
19
STRAINER
11
LIQUID L.P.G. TANK
28c
28
57
48
FILTER
35
44
43
36 SIPHON DRAIN
INST. AIR SUPPLY
47
52
37
COOLED WATER OUTLET
WARM WATER INLET
50
38
29
51
41
42
CONDENSED WATER DRAINER
31
DRAIN
39
40
WATER STRAINER
WATER DRAIN SEPARATOR
BLOW DOWN

BLENDING APPARATUS

BACKGROUND OF THE INVENTION

1. Field of the Invention

This invention relates to apparatus for supplying fluids and, in particular, to apparatus for providing a gaseous fuel fluid from a liquid fuel fluid supply.

2. Description of the Prior Art

At times, it is desirable to provide for delivery into a natural gas fuel supply, an augmenting quantity of gaseous fuel fluid. For such purposes, apparatus has been developed to provide a gaseous fuel fluid from a supply of liquefied fuel fluid, such as liquid propane, butane, and the like.

To provide the gaseous fuel fluid, the liquid fuel fluid is mixed with air and delivered to the natural gas supply as an aerated gaseous fuel fluid.

Liquefied propane is available as a byproduct of conventional oil refining and, thus, offers increased efficiency in the utilization of available energy sources. Conventional reserve supply apparatuses have utilized blenders which are of relatively low efficiency. Heretofore, such low efficiency has not proven a serious problem because of the intermittent need for such fuel augmentation. However, recently, it has been desirable to utilize such augmenting supplies on a continuous basis and, thus, maximizing the efficiency of the apparatus is an important consideration.

SUMMARY OF THE INVENTION

The present invention comprehends an improved high efficiency apparatus for providing from a liquid fuel fluid supply an aerated gaseous fuel fluid. The apparatus of the present invention utilizes heat of compression in a compressed air supply to vaporize a portion of the liquid fuel fluid. The vaporization action is utilized to condense moisture from the air supply and to provide cooling in a closed heat exchange system. The apparatus further effects superheating of the gaseous fluid for delivery to the desired point of use.

More specifically, the apparatus of the present invention includes a heat exchanger defining a lower chamber portion, an upper chamber portion, an inlet to a lower portion of the upper chamber portion, and an outlet from an upper portion of the upper chamber portion, means defining a flash chamber, and means for spraying liquid fuel fluid from the supply into the chamber for flashing of a portion thereof into the hot air therein. The flash chamber communicates with the heat exchanger chambers through the inlet for delivering liquid and gaseous fluid from the flash chamber thereto. In the heat exchanger, the liquid fluid collects in the lower chamber portion and the gaseous fluid passes upwardly through the upper chamber portion to the outlet. The apparatus further includes means for limiting the level of liquid fluid in the heat exchanger to a preselected level below the level of the inlet, and means for vaporizing liquid fuel fluid in the lower chamber portion for flow upwardly through the upper chamber portion to the outlet for providing with the gaseous fluid flowed from the inlet to the outlet an aerated gaseous fuel fluid.

The apparatus may further include means for separating liquid water condensed from the condensed air in the flash chamber as a result of the absorption of heat therefrom by the flashing liquid fuel fluid, the condensed water passing through the inlet into the lower chamber portion and separating from the liquid fuel fluid therein.

The invention further broadly comprehends the provision of an apparatus for providing from a liquid fuel fluid supply an aerated gaseous fuel fluid including a heat exchanger defining a lower chamber portion, an upper chamber portion, an inlet to a lower portion of the upper chamber portion, and an outlet from an upper portion of the upper chamber portion, means defining a flash chamber, means for delivering liquid fuel fluid from the supply into a stream of hot air and delivering the fluid mixture into the heat exchanger chamber wherein liquid fluid of the mixture collects in the lower chamber portion and gaseous fluid thereof passes upwardly through the upper chamber portion to the outlet, and means for limiting the level of liquid fluid in the heat exchanger to a preselected level below the level of the inlet including means responsive to variations in the liquid level to regulate the rate of delivery of the liquid fuel fluid into the air stream.

The level limiting means may include means responsive to a temperature condition of the apparatus, and in the illustrated embodiment, responsive to the temperature of a heat transfer fluid utilized to provide additional thermal energy to the fluid in the heat exchanger. The temperature responsive means may be connected in series with the level responsive means for controlling the liquid fluid supply.

In the illustrated embodiment, the liquid spraying means comprises a narrow angle spray nozzle. The spraying means may be arranged to direct the sprayed liquid countercurrently into the air stream. The apparatus may include means for superheating the gaseous fluid in the upper chamber portion and means for vaporizing liquid fuel fluid in the lower chamber portion. In the illustrated embodiment, these means are defined by a heat exchange duct carrying a heat exchange fluid, such as warm water, through the chambers. The temperature responsive means of the level limiting means may comprise a control responsive to the temperature of the water leaving the heat exchange duct.

Thus, the gaseous fluid supply apparatus of the present invention is extremely simple and economical of construction while yet providing the desirable features discussed above.

BRIEF DESCRIPTION OF THE DRAWING

Other features and advantages of the invention will be apparent from the following description taken in connection with the accompanying drawing wherein the drawing is a schematic flow diagram of the apparatus embodying the invention.

DESCRIPTION OF THE PREFERRED EMBODIMENT

In the exemplary embodiment of the invention as disclosed in the drawing, an apparatus generally designated 10 is shown for providing from a liquid fuel fluid supply 11, illustratively comprising a liquid low pressure tank supply, an aerated gaseous fuel fluid at an outlet 12 for delivery such as to a natural gas supply main for addition to the natural gas supply. The invention comprehends the utilization of a single heat exchanger 13 in conjunction with a flash tube 14 to provide in a simple and economical manner the desired fluid conversion.

The liquid fuel fluid is aerated by mixture therewith of hot air delivered to the flash tube 14 from a hot compressed air supply 15 which may comprise a conventional air compressor. The air may be delivered to the flash tube through suitable conduits including, in the illustrated embodiment, a reducing el 16 for flow through the flash chamber 17 of the flash tube 14 to an inlet 18 to the heat exchanger 13. Liquid fuel fluid is pumped by a suitable pump 57 from tank 11 through a suitable strainer 19 and liquid control valve 20 to a spray nozzle 21 arranged to spray the liquid fuel fluid into the flash chamber 17 countercurrently to the stream of hot air flowing therethrough to the inlet 18. Valve 20 may include a bypass 22, as shown in the drawing.

Spray nozzle 21 preferably comprises a narrow angle spray nozzle adapted to cause at least a portion of the liquid fuel fluid to vaporize in the flash chamber 17 thereby cooling the fluid therein and effectively condensing moisture in the hot compressed air stream. Resultingly, the momentum of the air stream carries through the inlet into the heat exchanger 13 a mixture of air, condensed moisture, gaseous fuel fluid, and liquid fuel fluid. The shell 23 of heat exchanger 13 defines an upper chamber portion 24 and a lower chamber portion 25. In the illustrated embodiment, inlet 18 enters the heat exchanger at a lower portion 26 of the upper chamber portion 24, permitting the liquid phase components of the delivered mixture to pass downwardly into the lower chamber portion 25 and the gaseous phase components to flow upwardly through upper chamber portion 24 to the outlet 12.

Upper chamber portion 24 may be provided with a plurality of baffles 27 for providing a tortuous flow path for the upwardly flowing gaseous fluids.

A heat exchange duct 28 extends between a lower header 29 and an upper header 30 for conducting a heat exchange fluid, such as warm water, through the chambers 24 and 25. Thus, as shown in the drawing, duct 28 includes a riser portion **28*a* and a return 28*b*. The conduit portions 28*a* and 28*b* are supported in the chamber portion 25 by suitable tube supports 28*c* and in the upper chamber portion 24 by the baffles 27**, as illustrated in the drawing.

A suitable valve drain 31 may be provided for draining the header 29 and a suitable relief valve 32 may be provided for providing a pressure relief to the heat exchanger at the upper portion 33 of the chamber portion 24.

Condensed water and the nonvaporized liquid fuel fluid delivered through inlet 18 into the heat exchanger is collected in the lower heat exchanger chamber portion 25. In the normal use of the apparatus, the upper level of the liquid is preferably maintained at a preselected level 34. The heavier condensed water collects below the relatively lighter liquid fuel fluid in the lower portion 35 of chamber portion 25 and is preferably discharged therefrom to permit maintained or continuous operation of the apparatus. For this purpose, a water eliminating means generally designated 36 is provided including an oulet 37 connected through a suitable duct 38 and water strainer 39 to a water drain separator 40. Separator 40 may include a suitable float controlled valve 41 which opens the outlet 42 thereof when the specific gravity of the fluid in the separator exceeds approximately 0.65. Valve 41 is arranged to be fully opened when the specific gravity of the fluid reaches 1.0 and, thus, functions to automatically discharge water from the system. A return duct 43 is connected between separator 40 and an inlet 44 to the heat exchange chamber portion 35 at a level above the level of the outlet 37 to provide a pressure head suitable to overcome the pressure drop of the ducts, valve, and strainer and permit a continuous delivery of the collected water to the separator for improved automatic removal thereof from the system.

The level of liquid in the heat exchanger is effectively limited to a maximum liquid level 45 by means of a liquid level control generally designated 46. In the illustrated embodiment, control 46 comprises a pneumatic control operated from a suitable air supply 47 delivering air through a filter 48 and a temperature control 49. The temperature control 49 senses the temperature of the heat exchange water discharged from the heat exchanger through an outlet 50 from lower header 29, the inlet 51 of the lower header being separated from the outlet by a suitable divider wall 52. The liquid level control includes a sensor 53 having a lower sensing portion 54 disposed at the preselected desired level 34 and an upper sensor 55 at a level above the maximum liquid level 45. The element 53 may be provided with a suitable valve drain 56.

As shown in the drawing, the liquid level control 46 is connected to the liquid control valve for controlling the rate of delivery of the liquid fuel fluid from tank 11 to spray nozzle 21 and, thus, maintains the desired level of liquid in the heat exchanger by decreasing the liquid fuel supply to the system when the level rises above the desired level and increasing the liquid fuel fluid supply when the level drops below the desired level 34.

Heat exchanger 13 thusly effectively defines an upper vaporizing zone and a lower superheating zone corresponding to the upper chamber 24 and lower chamber 25, respectively. The temperature in the lower zone 25 is substantially below the boiling temperature of water and the amount of heat introduced into the fluid by the heat exchanger fluid in duct 28 is insufficient to raise the temperature to the boiling point of water, thereby requiring the draining of the collected water as discussed above. However, the heat exchange water flowing through duct 28 is sufficient to vaporize the liquid fuel fluid so as to continuously cause augmentation of the aerated gaseous fuel fluid flowing upwardly through the upper chamber portion 24 from the inlet 18. Further, the flow of the gaseous phase through the upper chamber portion 24 in heat exchange association with the duct 28 in this upper portion causes a superheating of the gaseous phase fluids. The superheating is effectively maximized by the circuitous routing of the gaseous fluid by means of the baffles 27.

Pump 57 is arranged to pump the liquid from tank 11 at a suitable pressure to provide the desired spray-flash action in flash tube 14.

Suitable disconnect valves may be provided to permit removal and installation of the different elements of the apparatus as will be obvious to those skilled in the art.

The operation of apparatus 10 is extremely simple. Thus, liquid fuel fluid, such as liquid propane and the like, is pumped by pump 57 to be sprayed by nozzle 21 countercurrently into the stream of hot compressed air delivered from air supply 15 to the flash chamber 17. A portion of the liquid fuel fluid flashes into vapor in chamber 17 thereby absorbing heat of compression of the air and forming a two-phase fluid system as a result of the partial pressure relationship of the fuel fluid with the air. More specifically, moisture condenses from the compressed air with the heat of vaporization being utilized to effect the vaporization of the liquid fuel fluid. The mixture of remaining liquid fuel fluid, vaporized fuel fluid, condensed moisture, and air is delivered through the heat exchanger inlet 18 into the heat exchanger wherein the liquid components of the two-phase mixture drop by gravity into the lower portion 25 and the gaseous components flow upwardly through the upper portion 24 to the outlet 12.

As the condensed water has a specific gravity approximately twice that of the liquid fuel fluid, it settles to the bottom portion 35 of the heat exchanger where, as discussed above, the siphon drain 36 effects automatic removal thereof from the system. The liquid fuel fluid in portion 25 is vaporized by the heat exchange relationship thereof with the warm water flowed through duct 28. The resultant gaseous fuel fluid bubbles upwardly from the liquid into the upper chamber 24 for blending with the air and flashed gaseous fuel fluid flowing upwardly therethrough from inlet 18.

In upper chamber portion 24, the gaseous fluids are heated by the duct 28 whereby the gaseous fluid is superheated to a desired discharge temperature which is a function of the warm water temperature flowed through the duct 28.

The level of liquid in heat exchanger 14 is effectively maintained approximately at level 34 by the action of temperature control 49 and liquid level control 46. As shown, these controls are connected in series, and in the illustrated embodiment, comprise pneumatic controls wherein the pneumatic control air supply is directed firstly to the temperature control 49 and then to the liquid level control 46. The output of liquid level control 46 is applied against the diaphragm valve 20, as shown by the dotted line in the drawing. Valve 20 resultingly controls the rate of delivery of the liquid fuel fluid from pump 57 to spray nozzle 21 so as to regulate the amount of fuel fluid being delivered to the heat exchanger as a function of the liquid level.

Temperature control 49 is a reverse acting control which responds to the temperature of the heat exchange water at outlet 50 so that when the temperature is below a preselected temperature, control 49 decreases the air flow from supply 47 to liquid level control 46 and thereby decreases the air pressure opening valve 20 to correspondingly reduce the amount of liquid fuel delivered to the spray nozzle. At this time, the indicated level control 46 is full open assuming that the liquid level in the heat exchanger is below the preselected level 34. Temperature control 49 senses a condition at outlet 50 of insufficient heat in the heat exchange water to vaporize the liquid phase up to maximum capacity and functions to limit liquid inlet flow. In this condition, the liquid phase level in the heat exchanger is below the preselected level and the level control is resultingly wide open so that control of valve 20 is effectively by temperature only. Level control 46 controls the liquid level only when there is sufficient heat in the heat exchange water to effect the desired rate of vaporization.

In the illustrated embodiment, the apparatus 10 is arranged to maximize the vaporization of the liquefied fuel fluid. As will be obvious to those skilled in the art, suitable automatic fuel mixture controls may be utilized with the apparatus for maintaining any desired mixture ratio. The disclosed apparatus provides maximum fuel supply such as required by gas distribution companies where the aerated gaseous fuel fluid discharged from outlet 12 is further blended into the main gas supply.

The present apparatus 10 provides a highly efficient fuel vaporization operation with an effectively closed heat cycle minimizing the need for applied heat and applied refrigeration. The apparatus automatically dehumidifies the mixing air. Further, the apparatus may utilize low level heat sources. The apparatus provides controlled superheating of the aerated gaseous fuel fluid and improved positive mixing of the air and vaporized fuel. An automatic regulation of the delivery of the liquid fuel into the system is provided for maximizing the vaporizing action.

The apparatus is extremely low cost as it utilizes the fuel as a refrigerant to obtain dehumidification and, in providing a flash chilling action, provides an improved vaporization of the liquid fuel. Minimizing the moving parts effectively minimizes maintenance costs. Because of the simple small vertical construction, a very small base area is required further simplifying installation in existing plants and minimizing interconnection with existing apparatus.

The foregoing disclosure of specific embodiments is illustrative of the broad inventive concepts comprehended by the invention.

I claim:

1. Apparatus for providing from a liquid fuel fluid supply an aerated gaseous fuel fluid, comprising: heat exchanger means defining a chamber having a lower chamber portion and an upper chamber portion, an inlet to a lower portion of said upper chamber portion, and an outlet from an upper portion of said upper chamber portion; means defining a flash chamber; means for providing hot compressed air to said flash chamber; means for spraying liquid fuel fluid from said supply into said flash chamber for flashing of a portion thereof into the hot air therein, said flash chamber communicating through said inlet with said upper chamber portion for delivering liquid and gaseous fluid from said flash chamber into said heat exchanger chamber wherein the liquid fluid collects in said lower chamber portion and the gaseous fluid passes upwardly through said upper chamber portion to said outlet; means for limiting the level of liquid fluid in said heat exchanger to a preselected level below the level of said inlet; and means for vaporizing liquid fuel fluid in said lower chamber portion for flow upwardly through said upper chamber portion to said outlet for providing with the gaseous fluid flowed from the inlet to the outlet an aerated gaseous fuel fluid.

2. The apparatus of claim 1 wherein said liquid spraying means comprises a narrow angle spray nozzle.

3. The apparatus of claim 1 wherein said liquid spraying means comprises means for directing the sprayed liquid countercurrently into the air being delivered to the flash chamber.

4. The apparatus of claim 1 wherein means are provided for superheating the gaseous fluid in said upper chamber portion.

5. The apparatus of claim 1 wherein said means for vaporizing liquid fuel fluid in said lower chamber portion comprises a heat exchange tube for conducting warm fluid in heat exchange relationship to the liquid fluid in said lower chamber portion.

6. The apparatus of claim 1 wherein said means for vaporizing liquid fuel fluid in said lower chamber portion comprises a heat exchange tube for conducting warm fluid in heat exchange relationship to the liquid fluid in said lower chamber portion, and having an upper portion extending into said upper chamber portion for superheating gaseous fluid in said upper chamber portion.

7. The apparatus of claim 1 wherein said level limiting means comprises means responsive to variations in said liquid level to regulate the rate of delivery of liquid fuel fluid from said supply to said flash chamber.

8. The apparatus of claim 1 wherein said means for vaporizing liquid fuel fluid in said lower chamber portion comprises a heat exchange tube for conducting warm fluid in heat exchange relationship to the liquid fluid in said lower chamber portion, said level limiting means comprises means responsive to variations in the temperature of the fluid at an outlet of said heat exchanger tube to regulate the rate of delivery of liquid fuel fluid from said supply to said flash chamber.

9. Apparatus for providing from a liquid fuel fluid supply an aerated gaseous fuel fluid, comprising: heat exchanger means defining a chamber having a lower chamber portion and an upper chamber portion, an inlet to a lower portion of said upper chamber portion, and an outlet from an upper portion of said upper chamber portion; means defining a flash chamber; means for providing hot compressed air to said flash chamber; means for spraying liquid fuel fluid from said supply into said flash chamber for flashing of a portion thereof into the hot air therein, said flash chamber communicating through said inlet with said upper chamber portion for delivering liquid and gaseous fluid from said flash chamber into said heat exchanger chamber wherein the liquid fluid collects in said lower chamber portion and the gaseous fluid passes upwardly through said upper chamber portion to said outlet; means for limiting the level of liquid fluid in said heat exchanger to a preselected level below the level of said inlet; means for vaporizing liquid fuel fluid in said lower chamber portion for flow upwardly through said upper chamber portion to said outlet for providing with the gaseous fluid flowed from the inlet to the outlet an aerated gaseous fuel fluid; and means for removing liquid water condensed from the compressed air in the flash chamber as a result of the absorption of heat therefrom by the flashing liquid fuel fluid, said condensed water passing through said inlet into said lower chamber portion and separating from the liquid fuel fluid therein.

10. The apparatus of claim 9 wherein said water removing means comprises means for draining the collected water from a lower portion of said lower chamber portion and discharging the drained water from the apparatus.

11. The apparatus of claim 9 wherein said water removing means comprises means for draining the collected water from a lower portion of said lower chamber portion and discharging the drained water from the apparatus, said draining means including duct means having an inlet for receiving the collected water from said lower chamber portion at a preselected lower level, a return communicating with said lower chamber portion above the level of said duct means inlet, and a separator disposed intermediate said duct means inlet and return for selectively discharging water from the duct means.

12. The apparatus of claim 9 wherein said water removing means comprises means for draining the collected water from a lower portion of said lower chamber portion and discharging the drained water from the apparatus, said draining means including duct means having an inlet for receiving the collected water from said lower chamber portion at a preselected lower level, a return communicating with said lower chamber portion above the level of said duct means inlet, and a separator disposed intermediate said duct means inlet and return for selectively discharging water from the duct means, said separator including float controlled valve means for automatically discharging water from the separator as a function of the specific gravity of the fluid therein.

13. Apparatus for providing from a liquid fuel fluid supply an aerated gaseous fuel fluid, comprising: heat exchanger means defining a chamber having a lower chamber portion and an upper chamber portion, an inlet to a lower portion of said upper chamber portion, and an outlet from an upper portion of said upper chamber portion; means defining a flash chamber; means for delivering liquid fuel fluid from said supply into hot air in said flash chamber; means for delivering the resultant mixture of fuel fluid and air through said inlet into said heat exchanger chamber wherein liquid fluid of said mixture collects in said lower chamber portion and gaseous fluid thereof passes upwardly through said upper chamber portion to said outlet; and means for limiting the level of liquid fluid in said heat exchanger to a preselected level below the level of said inlet including means responsive to variations in the liquid level to regulate the rate of delivery of said liquid fuel fluid into said hot air.

14. The apparatus of claim 13 wherein said level limiting means further includes means responsive to a temperature condition of the apparatus to regulate said rate of delivery.

15. The apparatus of claim 13 wherein means are provided for conducting warm heat transfer fluid in heat transfer association with the fuel fluid in at least one of said chamber portions and said level limiting means further includes means responsive to the temperature of said heat transfer fluid subsequent to the heat transfer to regulate said rate of delivery.

16. The apparatus of claim 13 wherein means are provided for conducting warm heat transfer fluid in heat transfer association with the fuel fluid in at least one of said chamber portions and said level limiting means further includes means, connected in series with said means responsive to variations in the liquid level, responsive to the temperature of said heat transfer fluid subsequent to the heat transfer to regulate said rate of delivery.

* * * * *